US010228210B2

(12) United States Patent
Parker

(10) Patent No.: US 10,228,210 B2
(45) Date of Patent: Mar. 12, 2019

(54) SUPPRESSOR WITH VARYING CORE DIAMETER

(71) Applicant: CGS Group. LLC, Artesia, NM (US)

(72) Inventor: Joshua J. Parker, Artesia, NM (US)

(73) Assignee: CGS Group, LLC, Artesia, NM (US)

( * ) Notice: Subject to any disclaimer, the term of this patent is extended or adjusted under 35 U.S.C. 154(b) by 0 days.

(21) Appl. No.: 15/912,367

(22) Filed: Mar. 5, 2018

(65) Prior Publication Data

US 2018/0252489 A1 Sep. 6, 2018

Related U.S. Application Data

(60) Provisional application No. 62/467,030, filed on Mar. 3, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223
See application file for complete search history.

(56) References Cited

U.S. PATENT DOCUMENTS

| | | | | |
|---|---|---|---|---|
| 1,773,443 | A * | 8/1930 | Zygmunt | C09B 49/10 89/14.4 |
| 6,575,074 | B1 | 6/2003 | Gaddini | |
| 8,286,750 | B1 | 10/2012 | Oliver | |
| 9,052,152 | B2 | 6/2015 | Moss et al. | |
| 9,500,427 | B1 | 11/2016 | Larue | |
| 9,739,559 | B2 * | 8/2017 | Bush | F41A 21/30 |
| 2016/0209152 | A1 | 7/2016 | Dueck et al. | |

OTHER PUBLICATIONS

"Prospective Designs of Silencers"; Research and Production firm IMKAS; Captured and translated on Apr. 25, 2018; 31 pages.

* cited by examiner

*Primary Examiner* — Jeremy A Luks
(74) *Attorney, Agent, or Firm* — Lightfoot & Alford PLLC

(57) ABSTRACT

A firearm suppressor has a tube and a baffle stack carried within the tube. A first stack portion has a first inner volume defined by a first inner wall having a first diameter. A second stack portion has a second inner volume defined by a second inner wall having a second diameter unequal to the first diameter, the second stack portion being located forward of the first tube portion. A first outer volume has a first radial thickness formed between the first inner wall and the tube, and a second outer volume has a second radial thickness formed between the second inner wall and the tube. Vents in at least one of the stack portions allow gases and particulates to flow between the inner and outer volumes.

22 Claims, 18 Drawing Sheets

SUPPRESSOR WITH VARYING CORE DIAMETER

CROSS-REFERENCE TO RELATED APPLICATIONS

This disclosure claims the benefit of the filing date of U.S. Provisional Patent Application Ser. No. 62/467,030, filed on Mar. 3, 2017, and titled SUPPRESSOR WITH VARYING CORE DIAMETER, the content of which is incorporated by reference.

STATEMENT REGARDING FEDERALLY SPONSORED RESEARCH OR DEVELOPMENT

Not applicable.

BACKGROUND

Suppressors for firearms are designed to dissipate the energy of gases and particulates discharged from the muzzle to reduce the ambient noise created by the discharge. Typical suppressors have a plurality of baffles carried within a tube or other housing, and the baffles may be of various designs. Each baffle has a bore for allowing a projectile to pass through the baffle, and the baffles are arranged in a stack for aligning the bores.

DETAILED DESCRIPTION

Figure 1:
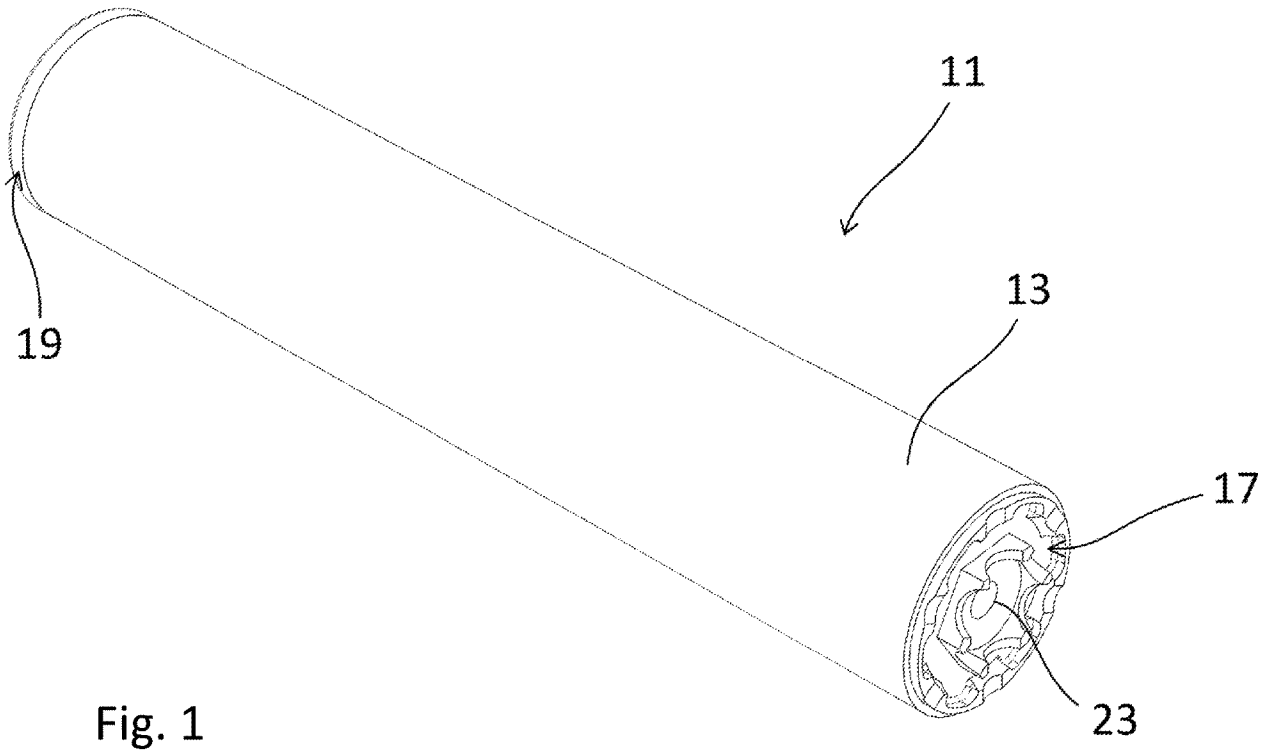
FIG. 1 is an oblique view of a suppressor according to this disclosure.

In the specification, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

This disclosure divulges a new concept for firearm suppressors, in which a core of the suppressor has a varying diameter. A baffle stack having stack portions of unequal diameter forms a plurality of inner and outer volumes of varying size within the suppressor. At least one vent allows for the flow of gases and particulates between at least one of the inner volumes and at least one of the outer volumes. When assembled together or formed in a stack, the baffles have aligned, coaxial bores and may be symmetrical or asymmetrical about the bores to form the volumes. The volumes may be coaxial and symmetrical about the aligned bores or may be asymmetrical.

FIGS. 1 through 4 illustrate a suppressor 11, and components thereof, according to this disclosure. Suppressor 11 is an assembly of a tube 13, a core 15, a front cap 17, and a rear cap 19. Rear cap 19 has a bore 21 configured to couple suppressor 11 to a muzzle of a firearm, and front cap 17 has a bore 23 for allowing a projectile fired from the firearm to pass through cap 17. As described more fully below, core 15 comprises a stack of baffles and transition components, such as reducers or enlargers, carried within tube 13. Components of suppressor 11 may have specific configurations for each embodiment, but these components generally operate in the same manner and are preferably interchangeable between embodiments.

Figure 2:
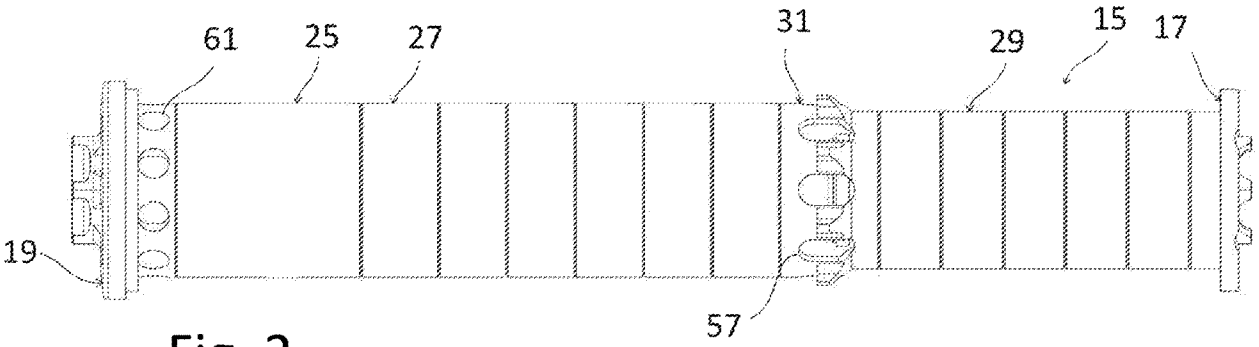
FIG. 2 is a side view of a core of the suppressor of FIG. 1.
Figure 3:
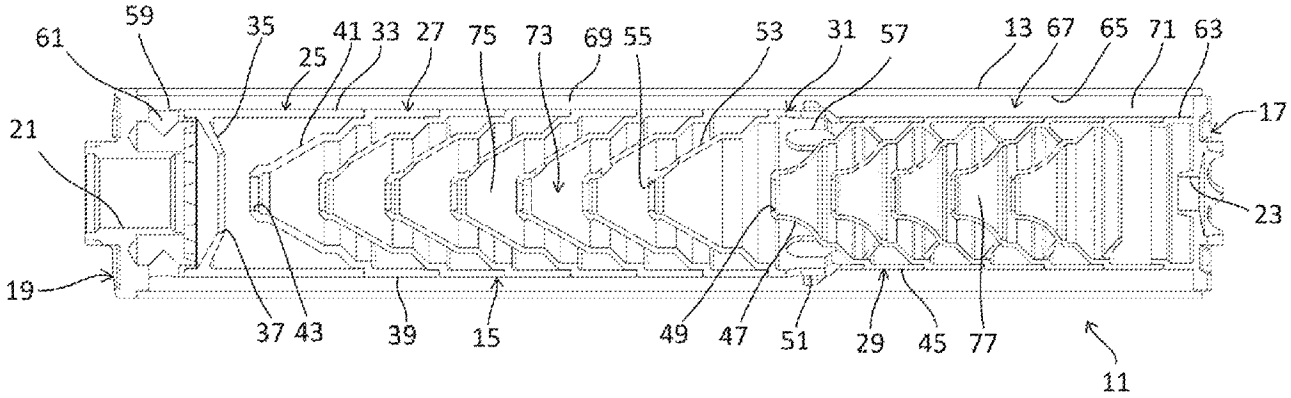
FIG. 3 is a cross-section side view of the suppressor of FIG. 1.
Figure 4:
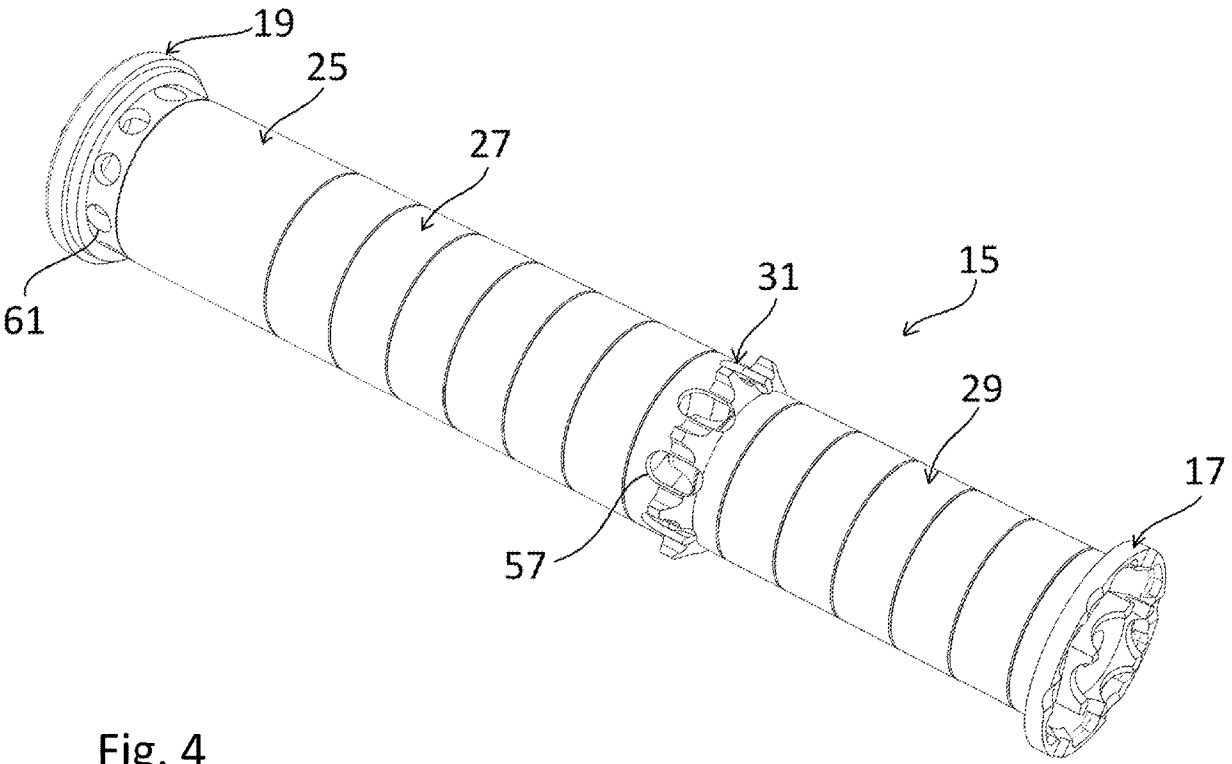
FIG. 4 is an oblique view of the core of FIG. 2.

Referring specifically to FIGS. 2 through 4, the coaxial baffle stack of core 15 comprises a rearward deflector baffle 25, large-diameter baffles 27, medium-diameter baffles 29, and reducer baffle 31. Deflector baffle 25 has a cylindrical wall 33 and a coaxial, conical blast deflector 35 with a bore 37 preferably having a larger diameter than bore 23 of front 17. Baffles 27 each have a cylindrical wall 39 and a coaxial inner cone 41 extending rearward and having a bore 43. Likewise, baffles 29 each have a cylindrical wall 45 and a coaxial inner cone 47 extending rearward and having a bore 49. Baffles 27 are arranged end to end to form a stack portion within tube 13, and baffles 29 are arranged end to end to form a stack portion within tube 13, each stack portion defining a coaxial bore, the bores being coaxial with each other, with bore 21 of rear cap 19, and with bore 23 of front cap 17.

Reducer baffle 31 has a wall 51 with a rearward diameter approximately equal to that of baffles 27 and a forward diameter approximately equal to that of baffles 29, allowing reducer baffle 31 to form a transition from baffles 27 to baffles 29. Reducer baffle 31 also comprises an optional coaxial inner cone 53 extending rearward and having a bore 55. In the embodiment shown, reducer baffle 31 also comprises optional intermediate vents 57 formed in wall 51. Rear cap 19 has a forward wall 59 that has a diameter approximately equal to that of baffles 27 and, in the embodiment shown, comprises optional rear vents 61 formed in wall 59. Front cap 17 has a rearward wall 63 that has a diameter approximately equal to that of baffles 29.

When core 15 is assembled within tube 13, walls 33, 39, 45, 51, 59, 63 are radially spaced from an inside surface 65 of tube 13, forming a coaxial outer volume 67. Volume 67 has two sections, with walls 33, 39, 59 defining rearward outer volume 69 and walls 45, 51, 63 defining forward outer volume 71. Because of the difference in diameter between baffles 27 and baffles 29, the radial thickness of volume 71 is larger than that of volume 69. The rearward end of volume 69 is defined by rear cap 19, and the forward end of volume 71 is defined by front cap 17. In the embodiment shown, volumes 69, 71 together form a continuous outer volume 67, though one or more optional separator disks (not shown) may be provided to form one or more separate outer volumes, the separator disks being formed on one or more of the components of core 15 or as one or more separate components assembled into core 15.

Walls 33, 39, 45, 51, 59, 63 form a coaxial inner volume 73 within core 15. Volume 73 has two sections, with walls 33, 39, 59 defining rearward inner volume 75 and walls 45, 51, 63 defining forward inner volume 77. Because of the difference in diameter between baffles 27 and baffles 29, the diameter of volume 75 is larger than that of volume 77. The rearward end of volume 75 is defined by rear cap 19, and the forward end of volume 77 is defined by front cap 17. Vents 57, 61 allow for gases and particulates to pass between inner volume 73 and outer volume 67. In the embodiment shown, rear vents 61 allow for gases and particulates to flow to outer volume 69 from the portion of rear inner volume 75 formed between rear cap 19 and blast deflector 35, though vents 61 may alternatively be formed in outer wall 33 of deflector baffle 25.

Figure 5:
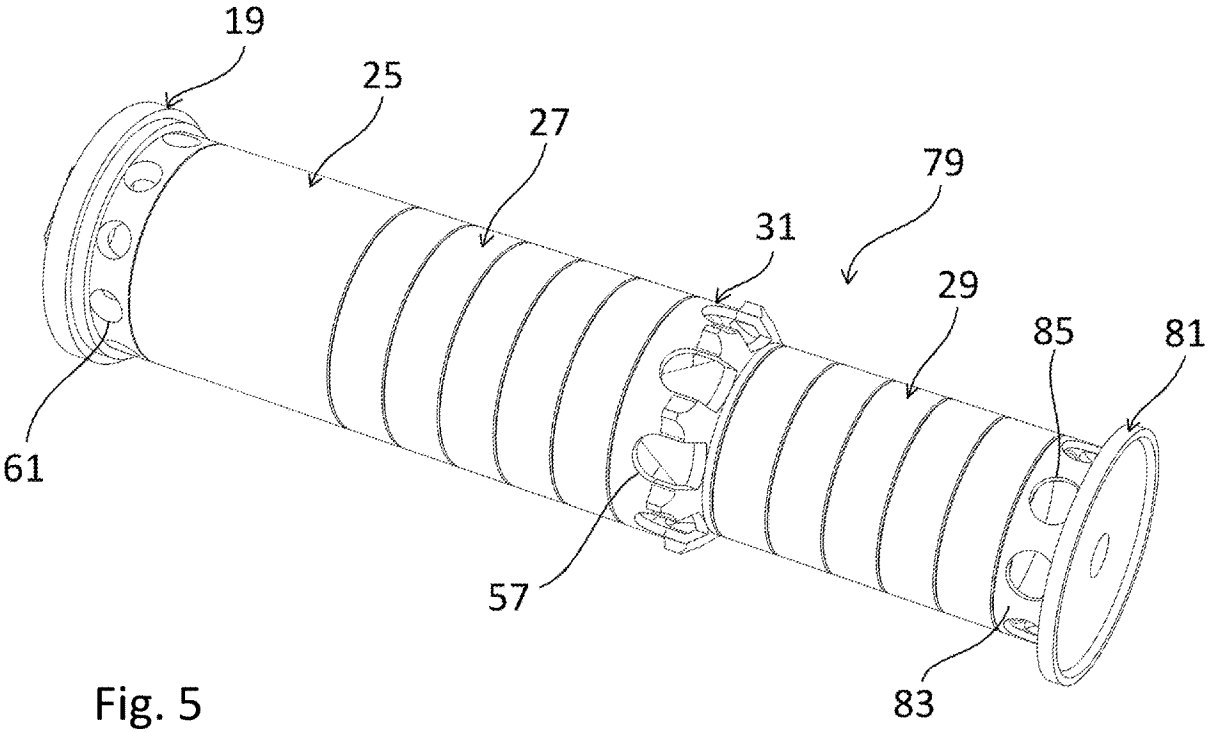
FIG. 5 is an oblique view of an alternative embodiment of a suppressor core according to this disclosure.
Figure 6:
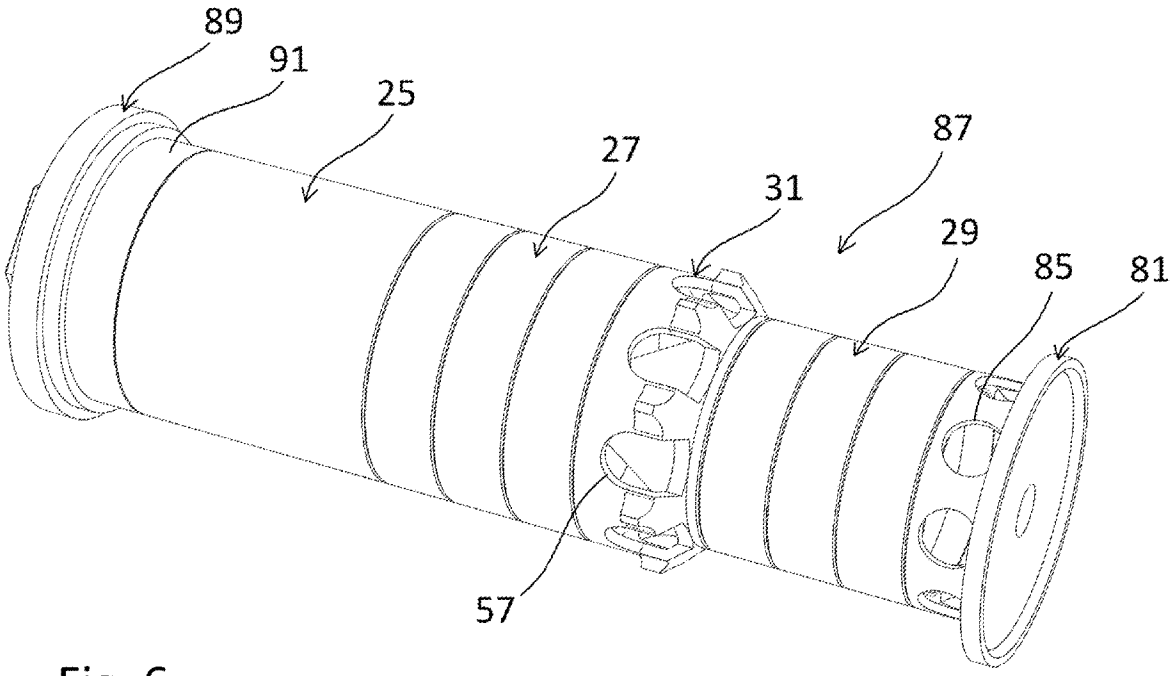
FIG. 6 is an oblique view of an alternative embodiment of a suppressor core according to this disclosure.

FIGS. 5 and 6 illustrate additional embodiments of a stack for use as a core for suppressor 11 and configured like core 15, with a single step down in the diameter of forward baffles. In FIG. 5, stack 79 comprises rear cap 19, deflector baffle 25, large-diameter baffles 27, medium-diameter baffles 29, reducer baffle 31, and front cap 81. Front cap 81 comprises a rearward wall 83 with optional front vents 85 formed in wall 83 for allowing gases and particulates to pass between an inner volume of stack 79 and an outer volume formed between stack 79 and tube 13. In FIG. 6, stack 87 comprises rear cap 89, deflector baffle 25, large-diameter baffles 27, medium-diameter baffles 29, reducer baffle 31, and front cap 81 Rear cap 89 comprises a forward wall 91 that lacks optional rear vents.

FIGS. 7 through 14 illustrate additional embodiments of a stack for use as a core in a suppressor according to this disclosure, but these embodiments include more than one change in baffle diameter along the length of the stack.

Figure 7:
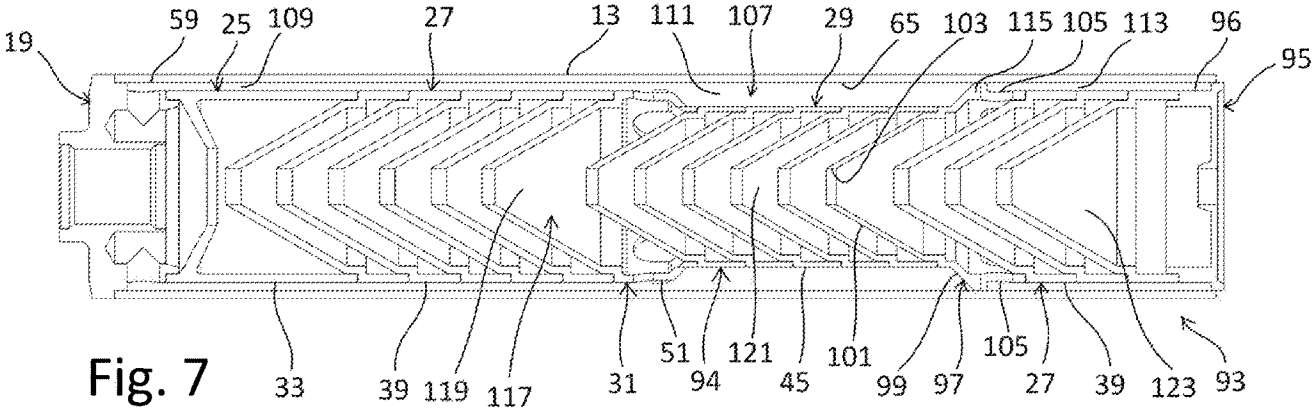
FIG. 7 is a cross-section side view of an alternative embodiment of a suppressor according to this disclosure.
Figure 8:
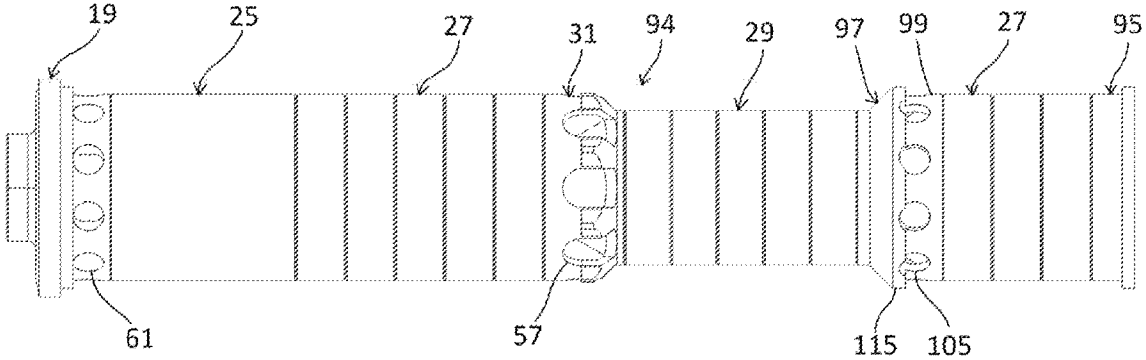
FIG. 8 is a side view of a core of the suppressor of FIG. 7.
Figure 9:
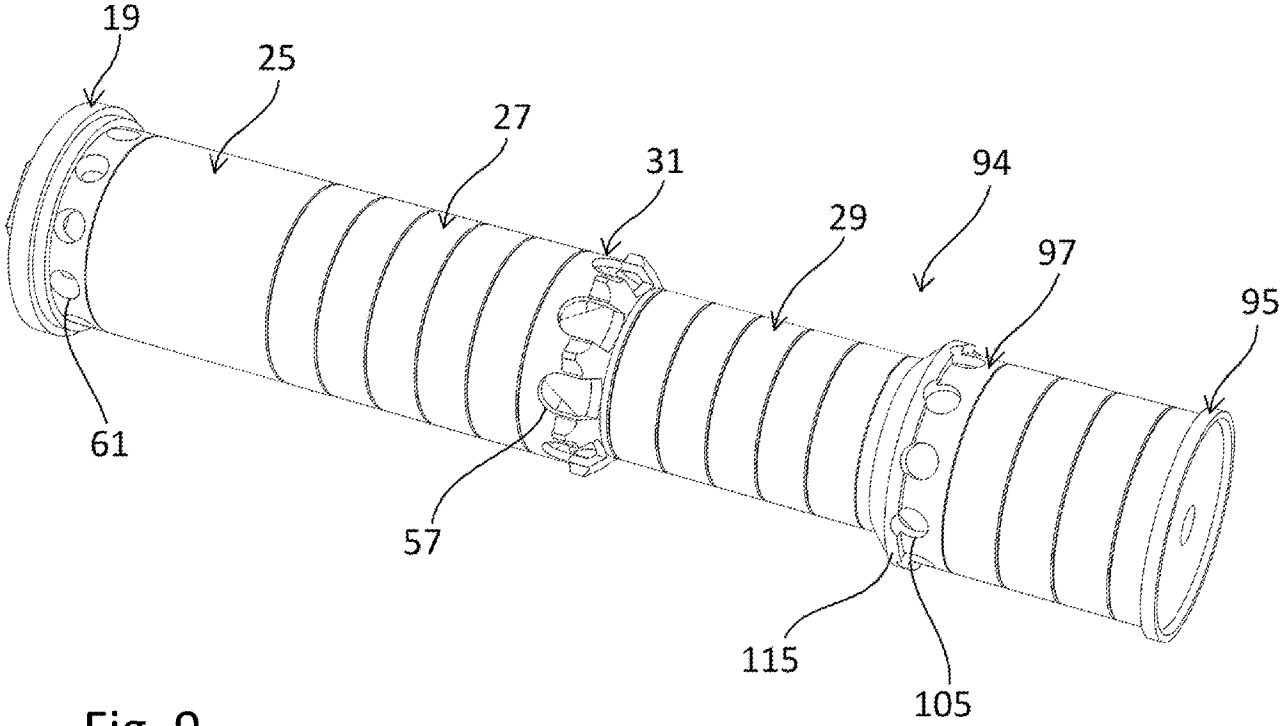
FIG. 9 is an oblique view of the core of FIG. 8.

FIGS. 7 through 9 illustrate a suppressor 93, which includes stack 94. Stack 94 comprises rear cap 19, deflector baffle 25, large-diameter baffles 27, reducer baffle 31, medium-diameter baffles 29, enlarger baffle 97, and front cap 95.

Enlarger baffle 97 has a wall 99 with a rearward diameter approximately equal to that of baffles 29 and a forward diameter approximately equal to that of baffles 27, allowing enlarger baffle 97 to form a transition from baffles 29 to baffles 27. Enlarger baffle 97 also comprises an optional coaxial inner cone 101 extending rearward and having a bore 103. In the embodiment shown, enlarger baffle 97 also comprises optional intermediate vents 105 formed in wall 99. Front cap 95 has rearward wall 96 with a diameter approximately equal to that of baffles 27.

When stack 94 is assembled within tube 13, walls 33, 39, 45, 51, 59, 96, 99 are radially spaced from inside surface 65 of tube 13, forming a coaxial outer volume 107. Volume 107 has three sections, with walls 33, 39 (of rearward baffles 27), 59 defining rearward outer volume 109, walls 45 defining intermediate outer volume 111, and walls 39 (of forward baffles 27), 96 defining forward outer volume 113. Because of the difference in diameter between baffles 27 and baffles 29, the radial thickness of volume 111 is larger than that of volumes 109, 113. The rearward end of volume 109 is defined by rear cap 19, and the forward end of volume 113 is defined by front cap 95. In the embodiment shown, volumes 109, 111 together form a continuous portion of outer volume 107. A separator disk 115 is formed on wall 99 of enlarger baffle 97, separating outer volume 113 from outer volume 111.

Volume 117 has three sections, with walls 33, 39 (of rearward baffles 27), 59 defining rearward inner volume 119, walls 45 defining intermediate inner volume 121, and walls 39 (of forward baffles 27), 96 defining forward inner volume 123. Because of the difference in diameter between baffles 27 and baffles 29, the diameter of volumes 119, 123 is larger than that of volume 121. The rearward end of volume 119 is defined by rear cap 19, and the forward end of volume 123 is defined by front cap 95. Vents 57, 61 allow for gases and particulates to pass between inner volume 117 and outer volumes 109, 111, and vents 105 allow for gases and particulates to pass between inner volume 117 and outer volume 113, which is separated from the remainder of volume 107 by an optional separator disk 115.

Figure 10:
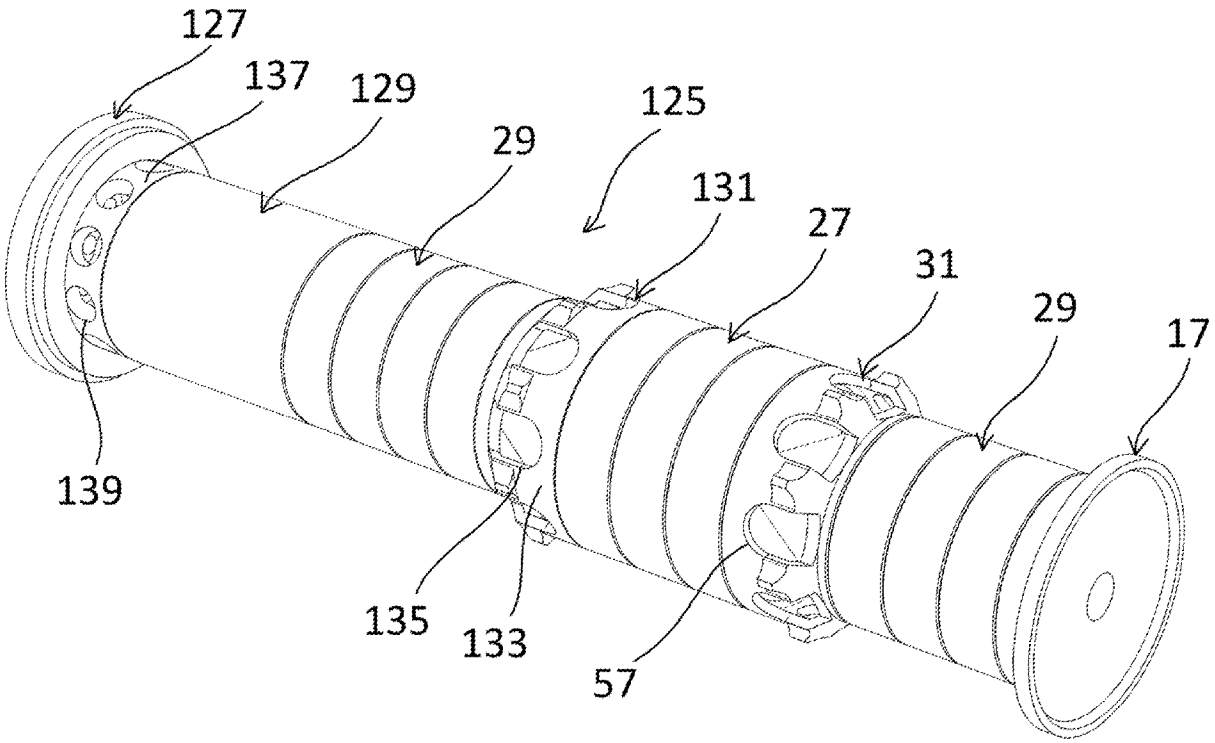
FIG. 10 is an oblique view of an alternative embodiment of a suppressor core according to this disclosure.
Figure 11:
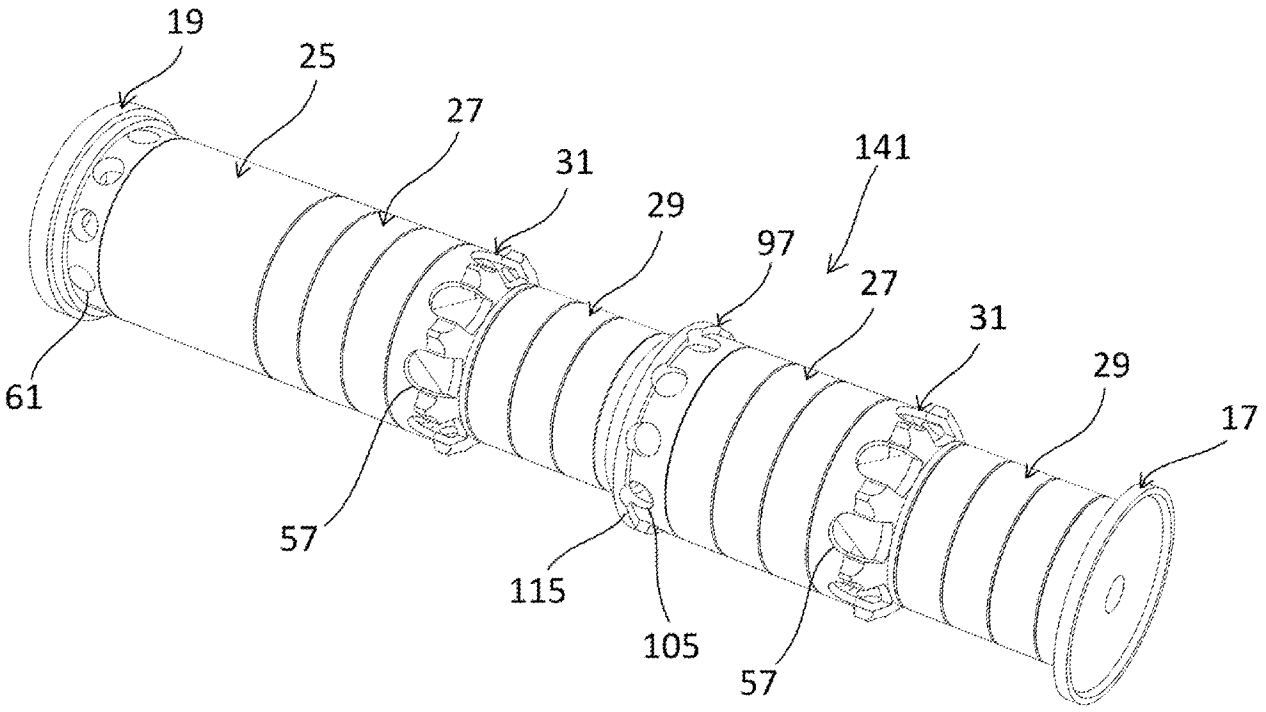
FIG. 11 is an oblique view of an alternative embodiment of a suppressor core according to this disclosure.

FIGS. 10 and 11 illustrate additional embodiments of a stack for use as a core for suppressor 93 and configured to have more than one change in the diameter of the baffles.

In FIG. 10, stack 125 comprises rear cap 127, deflector baffle 129, rearward medium-diameter baffles 29, enlarger baffle 131, large-diameter baffles 27, reducer baffle 31, forward medium-diameter baffles 29, and front cap 17. Enlarger baffle 131 comprises a coaxial inner cone (not shown) and a wall 133, having a rearward diameter approximately equal to that of baffles 29 and a forward diameter approximately equal to that of baffles 27. Enlarger baffle 131 is shown with optional intermediate vents 135 formed in wall 133 for allowing gases and particulates to pass between an inner volume of stack 125 and an outer volume formed between stack 125 and tube 13. Enlarger baffle 131 lacks the optional separator disk formed on enlarger baffle 97, as described above. Rear cap 127 has a forward wall 137 with optional rear vents 139 formed therein. The configuration of stack 125 provides for an intermediate inner volume that has a larger diameter than that of rearward and forward inner volumes. This configuration also provides rearward and forward outer volumes having a larger radial thickness than an intermediate outer volume.

In FIG. 11, stack 141 comprises rear cap 19, deflector baffle 25, rearward large-diameter baffles 27 reducer baffle 31, rearward medium-diameter baffles 29, enlarger baffle 97, forward large-diameter baffles 27, reducer baffle 31, forward medium-diameter baffles 29, and front cap 17. The configuration of stack 141 provides for two intermediate inner volumes having different diameters and two intermediate outer volumes having different radial thicknesses.

Figure 12:
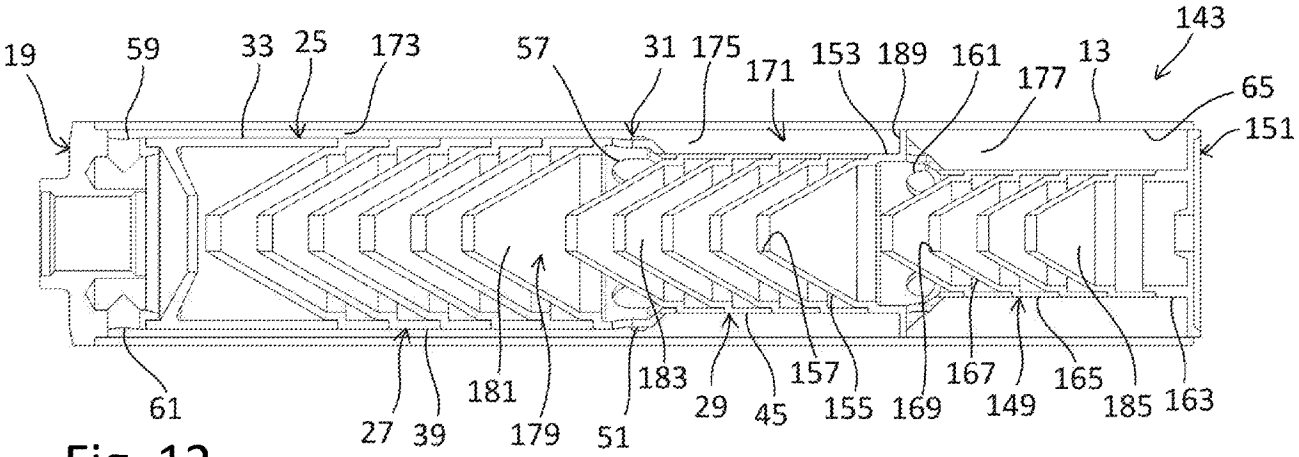
FIG. 12 is a cross-section side view of an alternative embodiment of a suppressor according to this disclosure.
Figure 13:
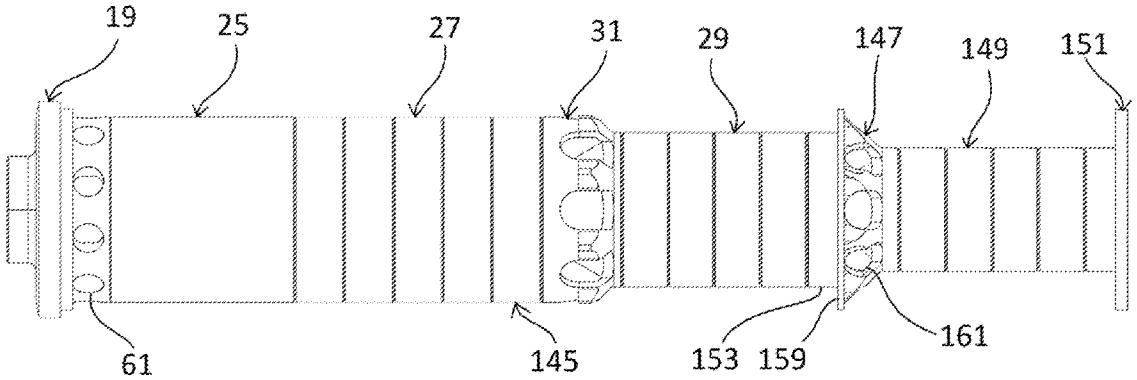
FIG. 13 is a side view of a core of the suppressor of FIG. 12.
Figure 14:
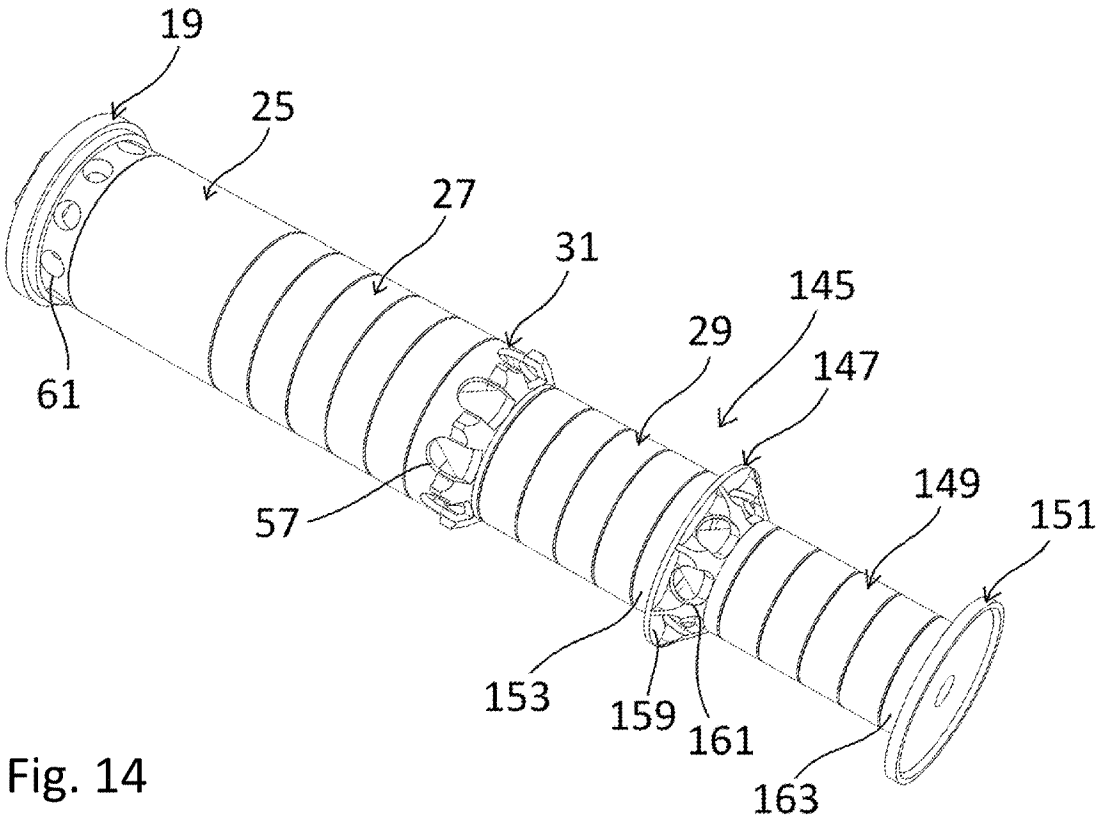
FIG. 14 is an oblique view of the core of FIG. 13.
Figure 15:
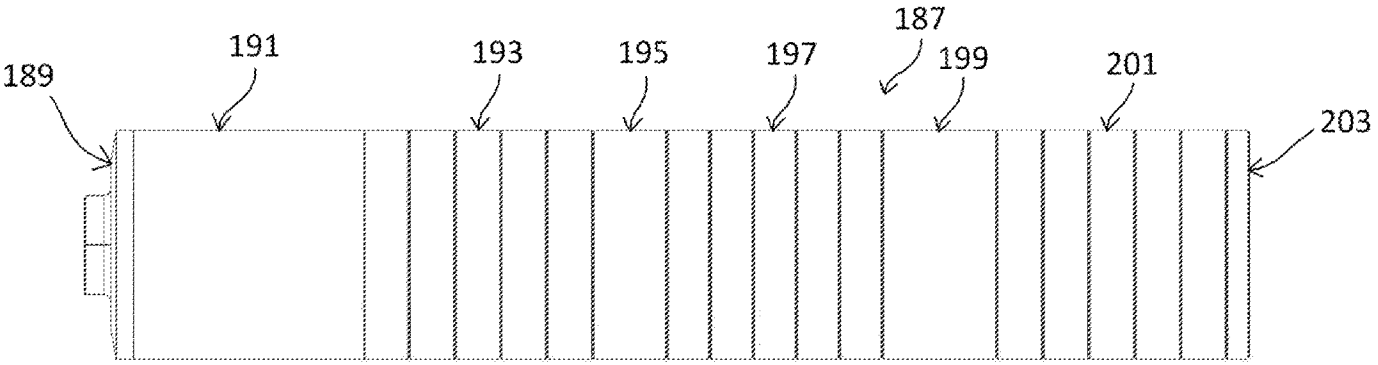
FIG. 15 is a side view of an alternative embodiment of a suppressor according to this disclosure.
Figure 16:
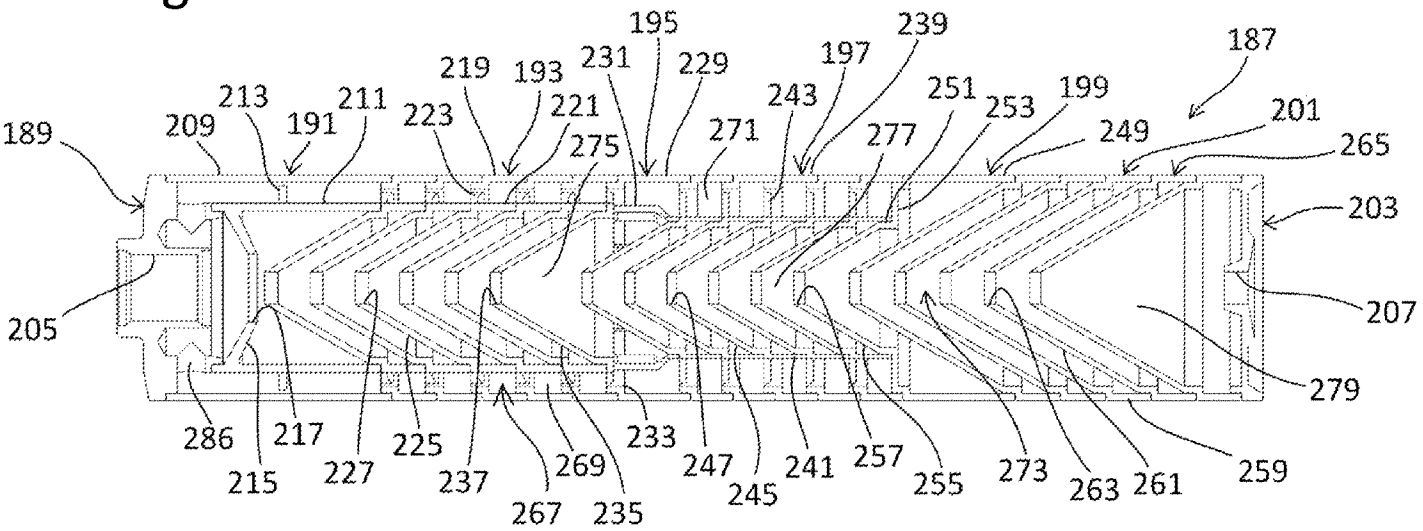
FIG. 16 is a cross-section side view of the suppressor of FIG. 15.
Figure 17:
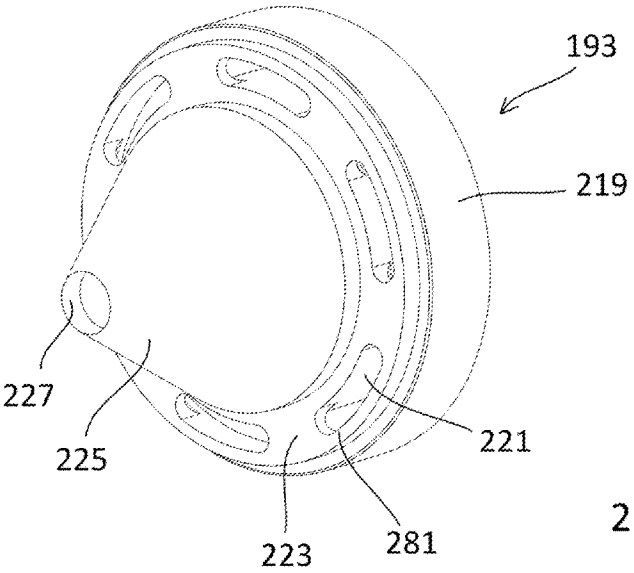
FIG. 17 is an oblique view of a component of the suppressor of FIG. 16.
Figure 18:
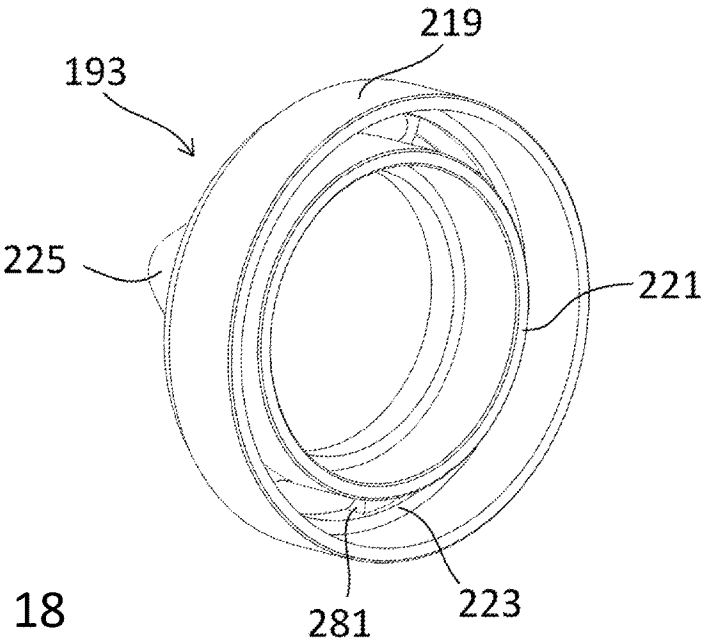
FIG. 18 is an oblique view of the component of FIG. 17.
Figure 19:
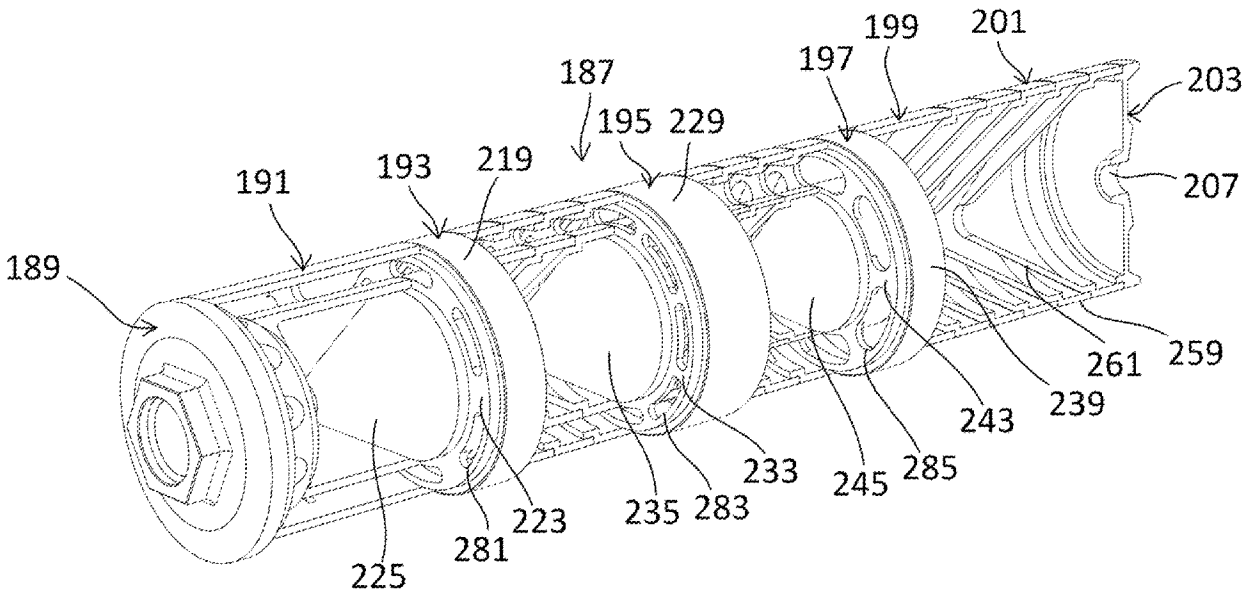
FIG. 19 is a partially sectioned oblique view of the suppressor of FIG. 15.
Figure 20:
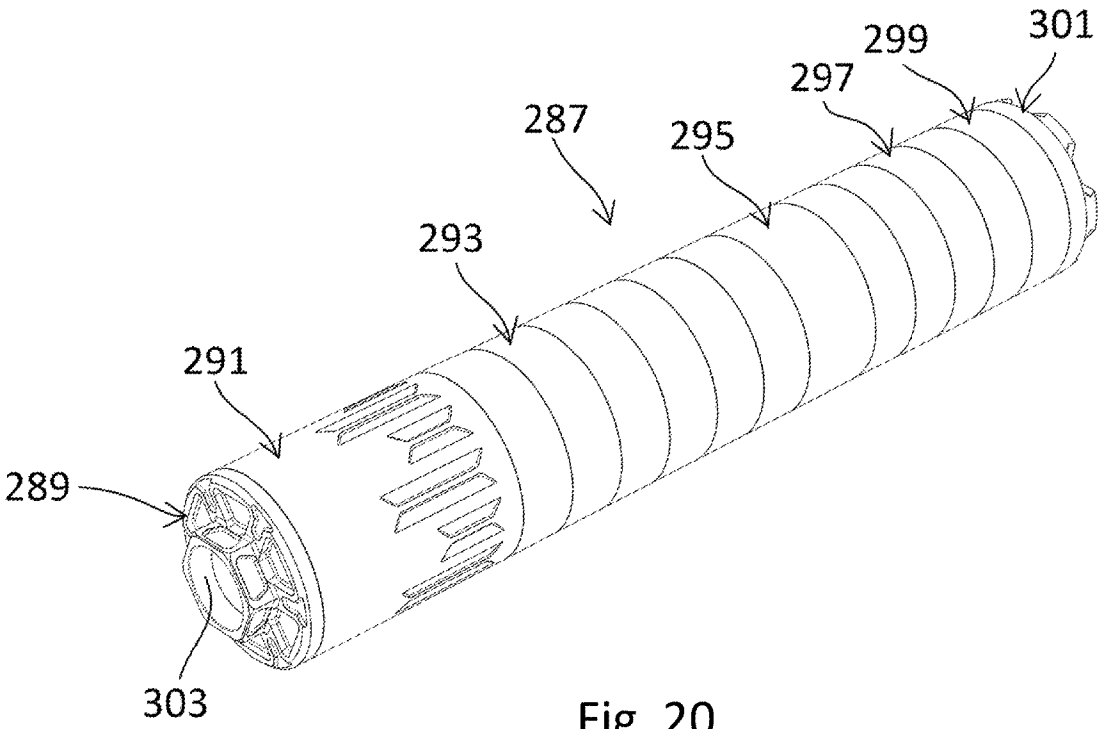
FIG. 20 is an oblique view of an alternative embodiment of a suppressor according to this disclosure.

FIGS. 12 through 14 illustrate a suppressor 143, which includes stack 145. Stack 145 comprises rear cap 19, deflector baffle 25, large-diameter baffles 27, reducer baffle 31, medium-diameter baffles 29, small reducer baffle 147, small-diameter baffles 149, and front cap 151.

Small reducer baffle 147 has a wall 153 with a rearward diameter approximately equal to that of baffles 29 and a forward diameter approximately equal to that of baffles 149, allowing reducer baffle 147 to form a transition from baffles 29 to baffles 149. Baffle 147 also comprises an optional coaxial inner cone 155 extending rearward and having a bore 157. In the embodiment shown, reducer baffle 147 also comprises optional separator disk 159 and intermediate vents 161 formed in wall 153. Front cap 151 has rearward wall 163 with a diameter equal to that of baffles 149. Small-diameter baffles 147 each have a wall 165 and a coaxial inner cone 167 extending rearward and having a bore 169.

When stack 145 is assembled within tube 13, walls 33, 39, 45, 51, 59, 153, 163 are radially spaced from inside surface 65 of tube 13, forming a coaxial outer volume 171. Volume 171 has three sections, with walls 33, 39, 59 defining rearward outer volume 173, walls 45 defining intermediate outer volume 175, and walls 165, 163 defining forward outer volume 177. Because of the difference in diameter between baffles 27, 29, 149, the radial thickness of volume 173 is smaller than that of volume 175, and the radial thickness of volume 175 is smaller than that of volume 177. The rearward end of volume 173 is defined by rear cap 19, and the forward end of volume 177 is defined by front cap 151. In the embodiment shown, volumes 173, 175 together form a continuous portion of outer volume 171. Optional separator disk 159 on wall 153 of reducer baffle 147 separates outer volume 177 from outer volume 175.

Walls 33, 39, 45, 51, 59, 153, 163 also define an inner volume 179 having three sections, with walls 33, 39, 59 defining rearward inner volume 181, walls 45 defining intermediate inner volume 183, and walls 165, 163 defining forward inner volume 185. Because of the difference in diameter between baffles 27, 29, 149, the diameter of volume 181 is larger than that of volume 183, and the diameter of volume 183 is larger than that of volume 185. The rearward end of volume 181 is defined by rear cap 19, and the forward end of volume 185 is defined by front cap 151. Vents 57, 61 allow for gases and particulates to pass between inner volume 179 and outer volumes 173, 175, and vents 161 allow for gases and particulates to pass between inner volume 179 and outer volume 177, which is separated from the remainder of volume 171 by separator disk 159.

FIGS. 15 through 19 illustrate a suppressor 187, and components thereof, which differs from embodiments shown above by using at least some baffles having a double wall design to form a coaxial outer volume, the outer walls of each component of suppressor 187 assembling together to form a tube.

Suppressor 187 comprises rear cap 189, deflector baffle 191, rear baffles 193, reducer baffle 195, intermediate baffles 197, spacer baffle 199, front baffles 201, and front cap 203. Rear cap 189 has a bore 205 configured to couple suppressor 187 to a muzzle of a firearm, and front cap 203 has a bore 207 allowing a projectile fired from the muzzle to pass therethrough. Deflector baffle 191 comprises a cylindrical outer wall 209, a coaxial cylindrical inner wall 211 spaced from outer wall 209 by perforated web 213, and a blast deflector 215 having a bore 217. Rear baffles 193 each comprise a cylindrical outer wall 219, a coaxial cylindrical inner wall 221 spaced from outer wall 219 by perforated web 223, and a cone baffle 225 having a bore 227. Reducer baffle 195 comprises a cylindrical outer wall 229, a coaxial inner wall 231 spaced from outer wall 229 by perforated web 233, and a cone baffle 235 having a bore 237. Intermediate baffles 197 each comprise a cylindrical outer wall 239, a coaxial inner wall 241 spaced from outer wall 239 by perforated web 243, and a cone baffle 245 having a bore 247. Spacer baffle 199 comprises a cylindrical outer wall 249, a coaxial inner wall 251 spaced from outer wall 249 by perforated web 253, and a cone baffle 255 having a bore 257. Front baffles 201 comprise outer wall 259 and a cone baffle 261 having a bore 263.

In suppressor 187, rear baffles 193 are arranged end to end to form a stack portion with coaxial bores 227, and intermediate baffles 197 are arranged end to end to form a stack portion with coaxial bores 247. When assembled together, outer walls 209, 219, 229, 229, 239, 249, 259 form a tube 265 and are preferably welded to each other. A coaxial outer volume 267 has two sections, with a rear outer volume 269 being formed between outer walls 209, 219 and inner walls 211, 221 and an intermediate outer volume 271 being formed between outer walls 239 and inner walls 241. An inner volume 273 has three sections, with a rear inner volume 275 defined by inner walls 211, 221, an intermediate inner volume 277 defined by inner walls 241, and a front inner volume 279 defined by outer walls 259.

Webs 213, 223, 233, 243, 253 are preferably perforated to allow gases and particulates to flow therethrough and create a single outer volume 267. As most easily viewed in FIGS. 17 through 19, examples of perforations are shown. Web 223 of each rear baffle 193 has slots 281, web 233 of reducer baffle 195 has slots 283, and web 243 of each intermediate baffle 197 has slots 285. The size and number of slots in webs 213, 223, 233, 243, 253 are selected to achieve the desirable amount of flow therethrough, and some webs may have no slots in order to separate sections of outer volume 267. Some components are preferably provided with vents to allow gases and particulates to pass between portions of inner volume 273 and portions of outer volume 267. It should be noted that, in the embodiment shown, front baffles 201 are not a double-wall design and do not form an outer volume, though in other embodiments double-wall baffles may be used. Gases and particulates are also able to flow through radial vents 286 formed in a forward portion of rear cap 189, vents 286 providing a flow path between the rear inner volume to the rear of blast deflector 215 and outer volume 269.

FIGS. 20 through 25 illustrate a suppressor 287, and components thereof. Like suppressor 187, the outer walls of each component of suppressor 287 assemble together to form a tube.

Suppressor 287 comprises rear cap 289, deflector baffle 291, rear baffles 293, spacer baffle 295, front baffles 297, forward-most baffle 299, and front cap 301. Rear cap 289 has a bore 303 configured to couple suppressor 287 to a muzzle of a firearm, and front cap 301 has a bore 305 allowing a projectile fired from the muzzle to pass therethrough. Deflector baffle 291 comprises a cylindrical outer wall 307, a coaxial cylindrical inner wall 309 spaced from outer wall 307 by perforated web 311, and a blast deflector 313 having a bore 315. Rear baffles 293 each comprise a cylindrical outer wall 317, a coaxial cylindrical inner wall 319 spaced from outer wall 317 by perforated web 321, and a cone baffle 323 having a bore 325. Spacer baffle 295 comprises a cylindrical outer wall 327 and a cone baffle 329 spaced from outer wall 327 by perforated web 331, cone baffle 329 having a bore 333. Front baffles 297 each comprise a cylindrical outer wall 335, a coaxial inner wall 337 spaced from outer wall 335 by perforated web 339, and a cone baffle 341 having a bore 343. A chamber wall 345 extends forward and inward generally from the intersection of outer wall 335 and cone baffle 341, wall 345 forming a frustum that engages a cone baffle 341 of an adjacent front baffle 297 for forming a coaxial chamber 347. A gas port 349 extends through wall 345 for allowing gases and particulates to flow from within cone baffle 341 into chamber 347. Forward-most baffle 299 comprises a cylindrical outer wall 351, a coaxial inner wall 353 spaced from outer wall 351 by perforated web 355, and a cone baffle 357 having a bore 359.

In suppressor 287, rear baffles 293 are arranged end to end to form a stack portion with coaxial bores 325, and front baffles 297 are arranged end to end to form a stack portion with coaxial bores 343. When assembled together, outer walls 307, 317, 327, 335, 351 form a tube 361 and are preferably welded to each other. A coaxial outer volume 363 has two sections, with a rear outer volume 365 being formed between outer walls 307, 317 and inner walls 309, 319 and a front outer volume 367 being formed between outer walls 335, 351 and inner walls 337, 353. An inner volume 369 has two sections, with a rear inner volume 371 defined by inner walls 309, 319 and a front inner volume 373 defined by inner walls 337, 353.

Figure 21:
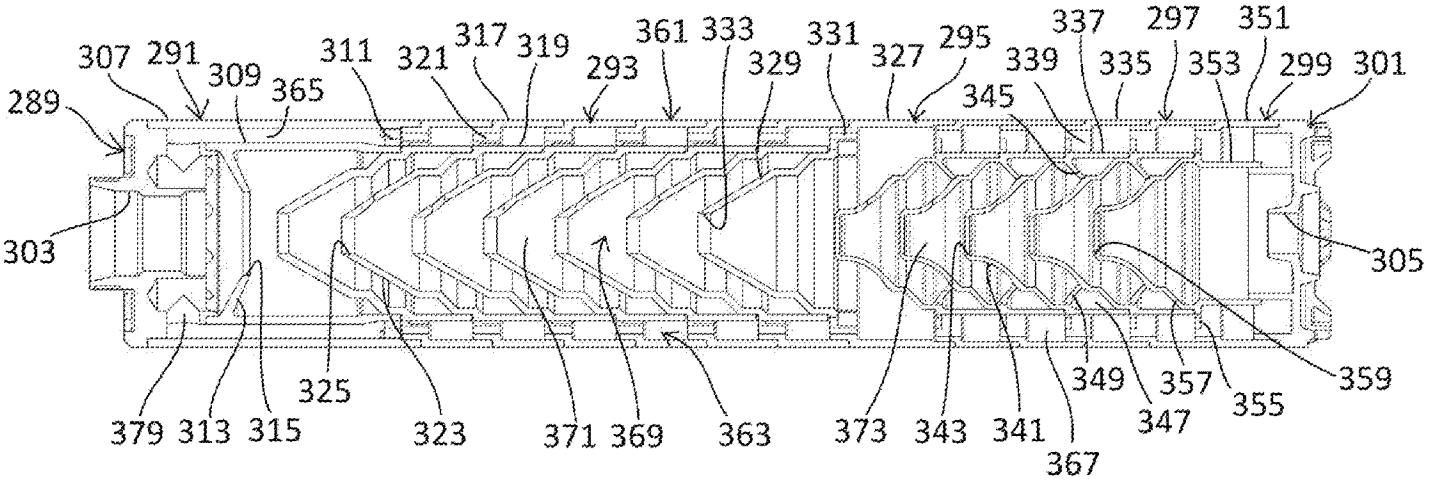
FIG. 21 is a cross-section side view of the suppressor of FIG. 20.
Figure 22:
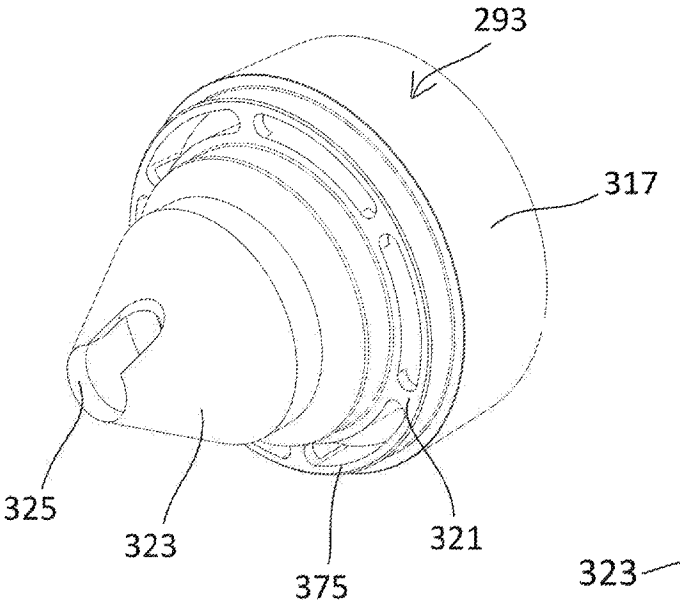
FIG. 22 is an oblique view of a component of the suppressor of FIG. 20.
Figure 23:
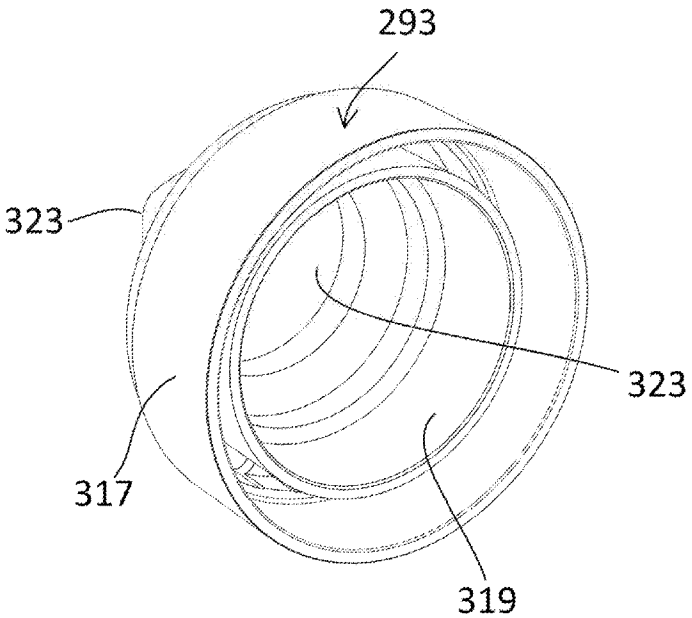
FIG. 23 is an oblique view of the component of FIG. 22.
Figure 24:
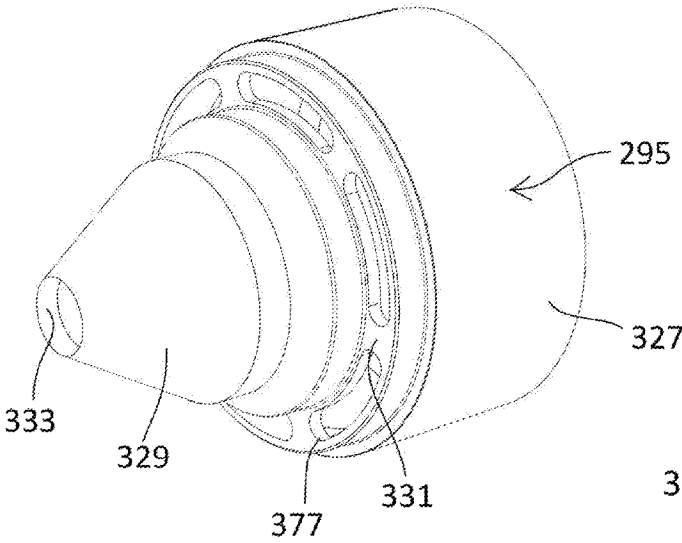
FIG. 24 is an oblique view of a component of the suppressor of FIG. 20.
Figure 25:
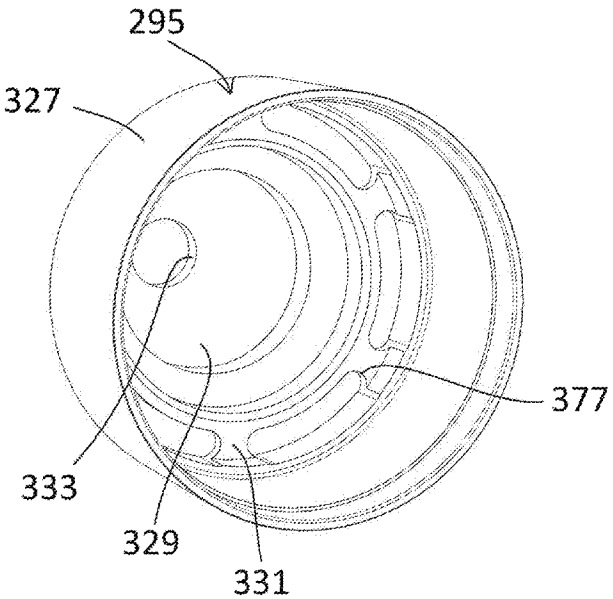
FIG. 25 is an oblique view of the component of FIG. 24.

Webs 311, 321, 331, 339, 355 are preferably perforated to allow gases and particulates to flow therethrough and create a single outer volume 363. As most easily viewed in FIGS. 21 and 22, showing a rear baffle 293, and FIGS. 23 and 24, showing spacer baffle 295, examples of perforations are shown. Web 321 of each rear baffle 293 has slots 375, and web 321 of spacer baffle 295 has slots 377. The size and number of slots in webs 311, 321, 331, 339, 355 are selected to achieve the desirable amount of flow therethrough, and some webs may have no slots in order to separate sections of outer volume 363. Because spacer baffle 295 has no inner wall, gases and particulates are allowed to pass between inner volume 369 and outer volume 363. Gases and particulates are also able to flow through radial vents 379 formed in a forward portion of rear cap 289, vents 379 providing a flow path between the rear inner volume to the rear of blast deflector 313 and outer volume 365.

In each embodiment, cylindrical walls of the various suppressor components preferably have approximately the same radial thickness. In addition, though shown as cylindrical components, components having various sizes, shapes, and configurations can be used to create suppressors according to this disclosure, including, for example, configurations in which the suppressor is asymmetrical about the bore of the baffle stack and configurations in which the baffles are asymmetrical about the muzzle. Also, the sizes of the inner and outer volumes may be altered by various means, such as, for example, varying the number and configuration of baffles, adding spacers in the core, and increasing the diameter of the inner volumes or radial thickness of the outer volumes. Embodiments are shown with particular baffle designs, though other baffle designs may be used. While these embodiments are shown with deflector baffles in a rearward location, these and other embodiments may alternatively omit the blast deflector. While shown as being assembled from separate components, suppressors and suppressor cores according to this disclosure may alternatively be formed as one or more pieces, and this may be accomplished using any appropriate methods, including for example, machining, casting, and additive manufacturing.

It is preferred that at least one additional set of vents is provided forward of vents at the rear of the suppressor for allowing gases and particulates to move between at least a portion of the inner volume of the core and an outer volume. Vents may be in other locations and have a different size or number than those shown, and the direction that gases and particulates flow between inner and outer volumes in an embodiment according to this disclosure may change based on the overall configuration of the suppressor, number and size of vents, and vent locations.

At least one embodiment is disclosed, and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 95 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Also, the phrases "at least one of A, B, and C" and "A and/or B and/or C" should each be interpreted to include only A, only B, only C, or any combination of A, B, and C.

What is claimed is:

1. A firearm suppressor, comprising: a tube; and a baffle stack carried within the tube, the stack comprising: a first stack portion with a first inner volume defined by a first inner wall having a first diameter, the first stack portion being located within a first tube portion; a second stack portion with a second inner volume defined by a second inner wall having a second diameter unequal to the first diameter, the second stack portion being located within a second tube portion forward of the first tube portion; and at least one vent located in a rear portion of the first stack portion; wherein a first outer volume having a first radial thickness is formed between the first inner wall and the tube, and a second outer volume having a second radial thickness is formed between the second inner wall and the tube; wherein the at least one vent is configured to allow gases and particulates to flow therethrough between the first inner volume and the first outer volume; and wherein the first stack portion is located in a rear portion of the tube.

2. The suppressor of claim 1, further comprising: at least one additional vent located in one of the stack portions and configured to allow gases and particulates to flow therethrough between at least one of the inner volumes and at least one of the outer volumes.

3. The suppressor of claim 1, further comprising: at least one vent located near a transition from the first stack portion to the second stack portion and configured to allow gases and particulates to flow therethrough between at least one of the inner volumes and at least one of the outer volumes.

4. The suppressor of claim 1, further comprising: at least one vent located in a forward portion of the second stack portion and configured to allow gases and particulates to flow therethrough between the second inner volume and the second outer volume.

5. The suppressor of claim 1, further comprising: a rear cap having at least one vent configured to allow gases and particulates to flow therethrough between a volume adjacent the rear cap and the first outer volume.

6. The suppressor of claim 1, further comprising: a blast deflector located in the first stack portion.

7. The suppressor of claim 1, further comprising: a transition component located between the stack portions and having a transition wall, a rear diameter of the transition wall being equal to the diameter of the first wall, a forward diameter of the transition wall being equal to the diameter of the second wall.

8. The suppressor of claim 1, further comprising: a transition component located between the stack portions and having a transition wall, a rear diameter of the transition wall being equal to the diameter of the first wall, a forward diameter of the transition wall being equal to the diameter of the second wall; and at least one vent formed in the transition wall.

9. The suppressor of claim 1, further comprising: a third stack portion with a third inner volume defined by a third inner wall having a third diameter, the third stack portion being located within a third tube portion forward of the first stack portion.

10. The suppressor of claim 1, wherein each baffle-stack portion has an outer wall, the outer walls forming the tube.

11. A firearm suppressor, comprising:

a first baffle-stack portion with a first inner volume defined by a first inner wall having a first diameter;

a second baffle-stack portion with a second inner volume defined by a second inner wall having a second diameter unequal to the first diameter, the second stack portion being located forward of the first stack portion; and at least one vent located in a rear portion of the first baffle-stack portion;

wherein each baffle-stack portion has an outer wall, the outer walls forming a tube;

wherein a first outer volume having a first radial thickness is formed between the first inner wall and the tube, and a second outer volume having a second radial thickness is formed between the second inner wall and the tube;

wherein the at least one vent is configured to allow gases and particulates to flow therethrough between the first inner volume and the first outer volume; and wherein the first baffle-stack portion forms a rear portion of the tube.

12. The suppressor of claim 11, further comprising: at least one additional vent located in one of the stack portions and configured to allow gases and particulates to flow therethrough between at least one of the inner volumes and at least one of the outer volumes.

13. The suppressor of claim 11, further comprising: at least one vent located near a transition from the first stack portion to the second stack portion and configured to allow gases and particulates to flow therethrough between at least one of the inner volumes and at least one of the outer volumes.

14. The suppressor of claim 11, further comprising: at least one vent located in a forward portion of the second stack portion and configured to allow gases and particulates to flow therethrough between the second inner volume and the second outer volume.

15. The suppressor of claim 11, further comprising: a rear cap having at least one vent configured to allow gases and particulates to flow therethrough between a volume adjacent the rear cap and the first outer volume.

16. The suppressor of claim 11, further comprising: a transition component located between the stack portions and having a transition wall, a rear diameter of the transition wall being equal to the diameter of the first wall, a forward diameter of the transition wall being equal to the diameter of the second wall.

17. The suppressor of claim 11, further comprising: a third baffle-stack portion with a third inner volume defined by a third inner wall having a third diameter, the third baffle-stack portion being located forward of the first stack portion.

18. The suppressor of claim 11, further comprising:

a blast deflector located in the first baffle-stack portion.

19. A firearm suppressor, comprising a tube; and a baffle stack carried within the tube, the stack comprising: a first stack portion with a first inner volume defined by a first inner wall having a first diameter, the first stack portion being located within a first tube portion; and a second stack portion with a second inner volume defined by a second inner wall having a second diameter unequal to the first diameter, the second stack portion being located within a second tube portion forward of the first tube portion; and a rear cap having at least one vent; wherein a first outer volume having a first radial thickness is formed between the first inner wall and the tube, and a second outer volume having a second radial thickness is formed between the second inner wall and the tube; and wherein the at least one vent is configured to allow gases and particulates to flow therethrough between a volume adjacent the rear cap and the first outer volume.

20. The suppressor of claim 19, further comprising: at least one vent located in one of the stack portions and configured to allow gases and particulates to flow therethrough between at least one of the inner volumes and at least one of the outer volumes.

21. The suppressor of claim 19, wherein each stack portion has an outer wall, the outer walls forming the tube.

22. The suppressor of claim 19, further comprising:

a blast deflector located in the first stack portion.

* * * * *